US006741018B2

(12) United States Patent
Bánkuti et al.

(10) Patent No.: US 6,741,018 B2
(45) Date of Patent: May 25, 2004

(54) LOW-PRESSURE DISCHARGE LAMP WITH CONNECTOR

(75) Inventors: László Bánkuti, Budapest (HU); József Fülöp, Budapest (HU); Sándor Lukács, Veröce (HU); Barnabás Nagy, Budapest (HU); Viktória Schmidt, Budapest (HU); Zoltán Vámos, Budapest (HU); István Würsching, Budapest (HU)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/974,185

(22) Filed: Oct. 9, 2001

(65) Prior Publication Data

US 2002/0105255 A1 Aug. 8, 2002

Related U.S. Application Data

(63) Continuation of application No. 09/233,260, filed on Jan. 19, 1999, now abandoned.

(30) Foreign Application Priority Data

Feb. 3, 1998 (HU) ..... 9800201
Dec. 10, 1998 (HU) ..... 9802864

(51) Int. Cl.[7] ..... H01J 5/48; H01J 5/50

(52) U.S. Cl. ..... 313/318.01; 313/318.02; 313/318.05; 313/318.06; 313/51; 362/260; 362/225; 362/226; 439/227; 439/236

(58) Field of Search ..... 313/318.01, 318.02, 313/318.05, 318.06, 51, 318.1, 264, 318.03; 362/226, 216–221, 225; 439/611–613, 617, 227, 236; 363/260

(56) References Cited

U.S. PATENT DOCUMENTS

| | | | | |
|---|---|---|---|---|
| 2,304,594 A | | 12/1942 | Pennybacker | 240/78 |
| 3,686,618 A | * | 8/1972 | Gales | 439/239 |
| 4,283,217 A | | 8/1981 | Kawamura | 65/108 |
| 4,458,301 A | | 7/1984 | Chapman et al. | 362/216 |
| 4,479,072 A | | 10/1984 | Gaugel et al. | 313/113 |

(List continued on next page.)

FOREIGN PATENT DOCUMENTS

| | | | |
|---|---|---|---|
| DE | 9208728 U | 9/1992 | |
| EP | 0 057 974 | 8/1992 | |
| EP | 971389 A1 * | 1/2000 | H01J/61/56 |

*Primary Examiner*—Vip Patel
*Assistant Examiner*—Sikha Roy
(74) *Attorney, Agent, or Firm*—Fay, Sharpe, Fagan, Minnich & McKee, LLP

(57) ABSTRACT

The present invention relates to a low-pressure discharge lamp (1) including a discharge tube (20) and a base (5) providing for mechanical and electrical connection of the discharge lamp (1). The discharge tube (20) sealed in a gas-tight manner at its both ends is bent substantially in one plane so that the discharge tube (20) has straight (2) and arc-shaped portions (3), and the base (5) connected to the ends of the discharge tube (20) includes at least cathode leads of the discharge tube (20) and electrical connectors (15) connected to said leads. At least one component ensuring mechanical connection to a lampholder is formed on the base (5). The components of the discharge lamp (1) ensuring mechanical connection to the lampholder (16) are placed in a space bordered by the discharge tube (20).

A lampholder (16) of the discharge lamp (1) includes components ensuring electrical and mechanical connection to the discharge lamp (1). The components of the lampholder (16) providing for mechanical connection to the discharge lamp (1) are placed in a space bordered by the discharge tube (20) in a position in which the lampholder (16) is connected to the discharge lamp (1).

8 Claims, 5 Drawing Sheets

U.S. PATENT DOCUMENTS 5,282,756 A * 2/1994 Heindl et al. ..... 439/336
5,285,128 A * 2/1994 Horvath et al. ..... 313/318.02
5,446,340 A 8/1995 Parillo et al. ..... 313/493
5,471,375 A 11/1995 Lau ..... 363/260
5,675,215 A 10/1997 Watson et al. ..... 313/493
5,789,849 A * 8/1998 Porembski et al. .... 313/318.02
D417,193 S * 11/1999 Itaya et al. ..... D13/136
6,083,021 A * 7/2000 Lau ..... 362/216

* cited by examiner

LOW-PRESSURE DISCHARGE LAMP WITH CONNECTOR

This application is a continuation of the U.S. Ser. No. 09/233,260, filed Jan. 19, 1999, now abandoned.

BACKGROUND OF THE INVENTION

This invention relates to a low-pressure discharge lamp comprising a discharge tube and a base providing for the electrical and mechanical connection of the lamp. It also relates to a lampholder of the low-pressure discharge lamp.

Low-pressure discharge lamps are known which comprise a discharge tube provided with a gas-tight seal at its ends and defining a discharge space, and a housing comprising a cap fixing the ends of the discharge tube and a base part. The best known form of the so-called compact fluorescent lamps of this type is in which the discharge tube is U-shaped. Low-pressure discharge lamps using this form of the discharge tube can be known, e.g. from U.S. Pat. No. 5,446,340. The characteristic feature of this discharge lamp is that the discharge tube consists of straight portions, arc-shaped portions connecting the straight portions and bridges. The straight portions are parallel both to each other and to the longitudinal axis of the lamp. Since the discharge tubes are arranged in space in these solutions in order that they can be connected, the disadvantage of this tube construction is that the lamps are "high" (long) and broad at the same time which is unfavorable in some fields of application.

Solutions, in which the discharge tube is bent to have a bi-directional spiral, i.e. a so-called helical form, are aimed at decreasing the height size of the lamp with the consequence that the height of the discharge tube and, together with this, that of the discharge lamp is also decreased. Such a solution can be known, e.g. from U.S. Pat. No. 5,675,215 where the height of the lamp is smaller than that of the U-shaped tubes but still exceeds its width.

In some fields of application, a demand for low-pressure discharge lamps with a very small height appeared wherein the lamp extends substantially only in two dimensions rather than three. In order to meet this requirement, ring-shaped discharge lamps were developed and among these, the lamps having so-called 2D-shaped discharge tubes have proven to be the most advantageous. A discharge lamp of this type is disclosed in patent specification No. EP 0 0057 974. In this, the known discharge tube also comprises straight and arc-shaped portions but these are formed substantially in the plane perpendicular to the height of the lamp, while the base is constructed in the direction of the height of the lamp and can be inserted in a lampholder being outside the plane of the discharge tube. The disadvantage of this solution is that the base and the lampholder protruding from the plane of the bent tube still require a substantial amount of space which restricts its field of application.

SUMMARY OF THE INVENTION

Thus there is a particular need for further decreasing the height of the discharge lamp having a discharge tube of 2D or similar shape and extending in a plane perpendicular to the height of the lamp, which lamp requires even less space than the prior art lamps.

According to a first aspect of the invention, a discharge lamp including a discharge tube and a base ensuring mechanical and electrical connection of the lamp and connected to the discharge tube is provided. The discharge tube sealed in a gas-tight manner at its both ends is bent in substantially one plane so that the discharge tube has straight and arc-shaped portions, and the base connected to the ends of the discharge tube includes at least cathode leads of the discharge tube and electrical connectors connected to said leads. At least one component providing for mechanical connection to a lampholder is formed on the base. Each component of the discharge lamp ensuring mechanical connection to the lampholder is placed in a space bordered by the discharge tube.

In accordance with another aspect of the present invention, a lampholder of a low-pressure discharge lamp is provided, and the lampholder has components ensuring electrical and mechanical connection to the discharge lamp having a discharge tube and a base. In a position in which the lampholder is connected to the discharge lamp, the components of the lampholder providing for mechanical connection to the discharge lamp are placed in a space bordered by the discharge tube.

An advantage of the present invention is that the height of the lamp having a discharge tube extending substantially one plane can be significantly decreased while preserving the necessary functions of the lamp. It is a further advantage that the base is made of a minimum amount of material and comprises only the inevitable components.

BRIEF DESCRIPTION OF THE DRAWINGS

The discharge lamp and the lampholder, in which the present invention is embodied, are described in detail by means of drawings. In the drawings.

DETAILED DESCRIPTION OF THE INVENTION

Figure 1:
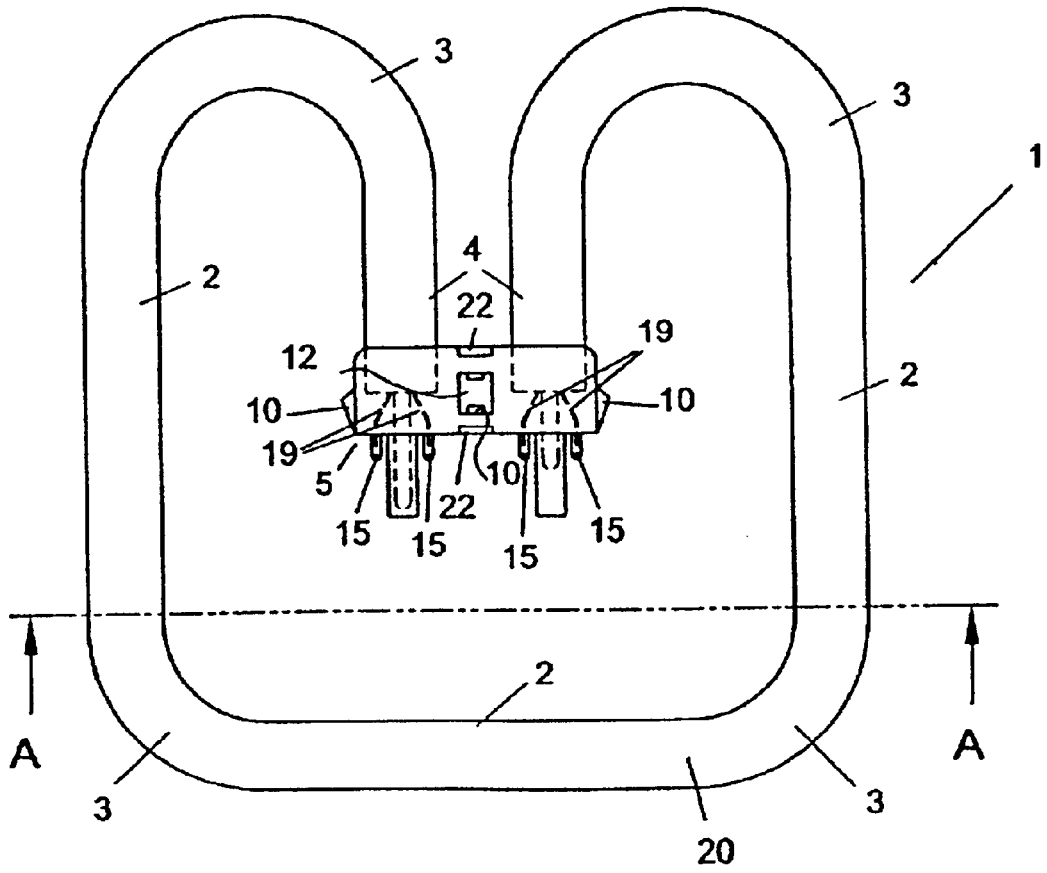
FIG. 1 is a top view of a possible embodiment of the discharge lamp.
Figure 2:
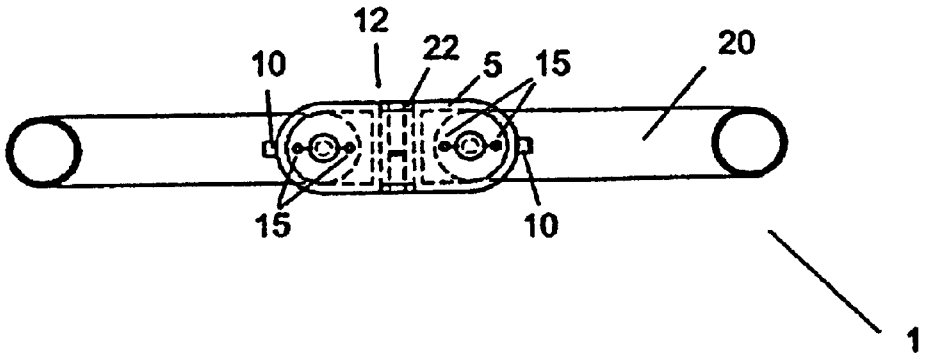
FIG. 2 is a side view section of the discharge lamp of FIG. 1 taken along the plane A—A.

As seen in FIGS. 1 and 2, the discharge lamp 1 comprises a discharge tube 20 consisting of straight tube portions 2 and arc-shaped portions 3 and also comprises a base 5 made of injection-molded plastic material in which tube ends 4 of the discharge tube 20 sealed in a gas-tight manner are fixed to the base 5 by means of an adhesive joint or in another known way. The discharge tube 20 is bent in substantially one plane to have a so-called 2D-shape, perpendicularly to the height of the lamp and its material as well as its inner structure correspond to the material and inner structure which are usual with the low-pressure discharge lamps. The tube ends 4 are substantially parallel to each other. The end seals are placed in the same direction and are substantially in line with each other and are positioned in the vicinity of the center of the plane figure bordered by the straight tube portions 2 and the arc-shaped portions 3. Electrical connectors 15 of cathode leads 19 of the discharge tube 20 are also fixed in the base 5 made of plastic material. An opening 12, fixing components 10 and seating surfaces 22 providing for mechanical connection of the discharge lamp 1 to a lampholder to be described later are also defined by the base 5. The fixing components 10 are placed partially in the opening 12 and partially on the outer side of the base 5 so that the discharge lamp 1 can be connected to a lampholder both in parallel and in perpendicular direction to the plane of the discharge tube 20. It is seen clearly in the figure that the axes of the connectors 15 are parallel to the plane of the discharge tube 20 and the connectors 15 do not protrude from a space bordered by the discharge tube 20. The space bordered by the discharge tube 20 means the space the bottom of which is bordered by the straight tube portions 2 and the arc-shaped portions 3, and the height of which is the diameter of the discharge tube 20 plus twice the wall thickness of the base 5 including a gap between the discharge tube 20 and the base 5 filled in by a bonding material if used. It is also seen that the base 5 does not protrude from this bordered space.

Figure 3:
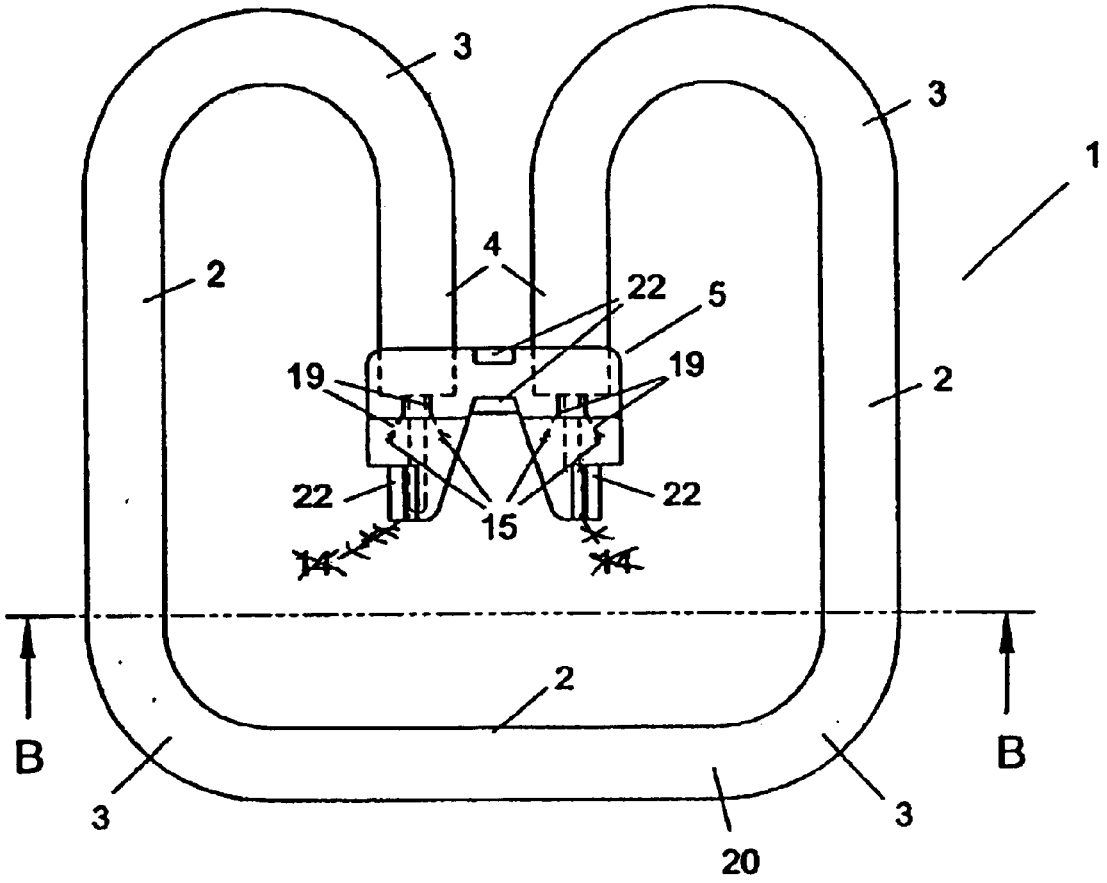
FIG. 3 is a the top view of a further possible embodiment of the discharge lamp.
Figure 4:
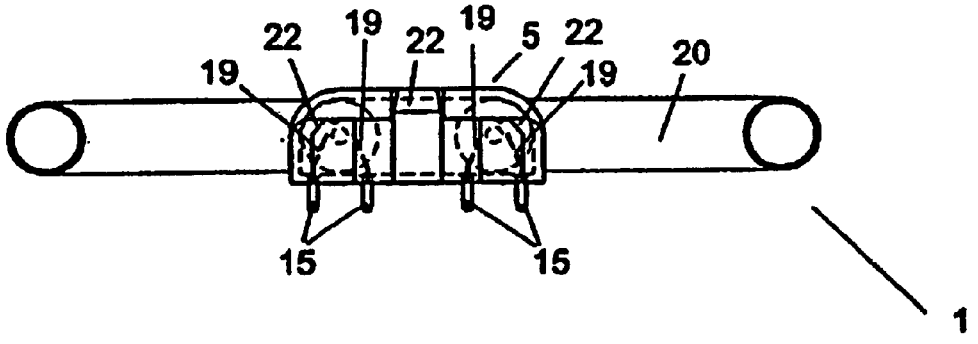
FIG. 4 is a side view section of the discharge lamp of FIG. 3 taken along the plane B—B.

The embodiment of the discharge lamp 1 shown in FIGS. 3 and 4 differs from that seen in FIGS. 1 and 2 only in the shape of the base 5, however the discharge tube 20 is completely the same as that described there. In this embodiment, the base 5 fixes the electrical connectors 15 connected to the cathode leads 19 in a position perpendicular to the plane of the discharge tube 20. The seating surfaces 22 providing for mechanical connection to a lampholder are formed in four places of the base 5, of which two are placed between the electrical connectors 15 and two are placed next to them. The position of the former ones and that of the latter ones are seen clearly in the side-view section of FIG. 4 and in FIG. 3, respectively. In this case also, it is seen in the sectional view that only the electrical connectors 15 protrude from the bordered space described above, and the base 5 does not.

Figure 5:
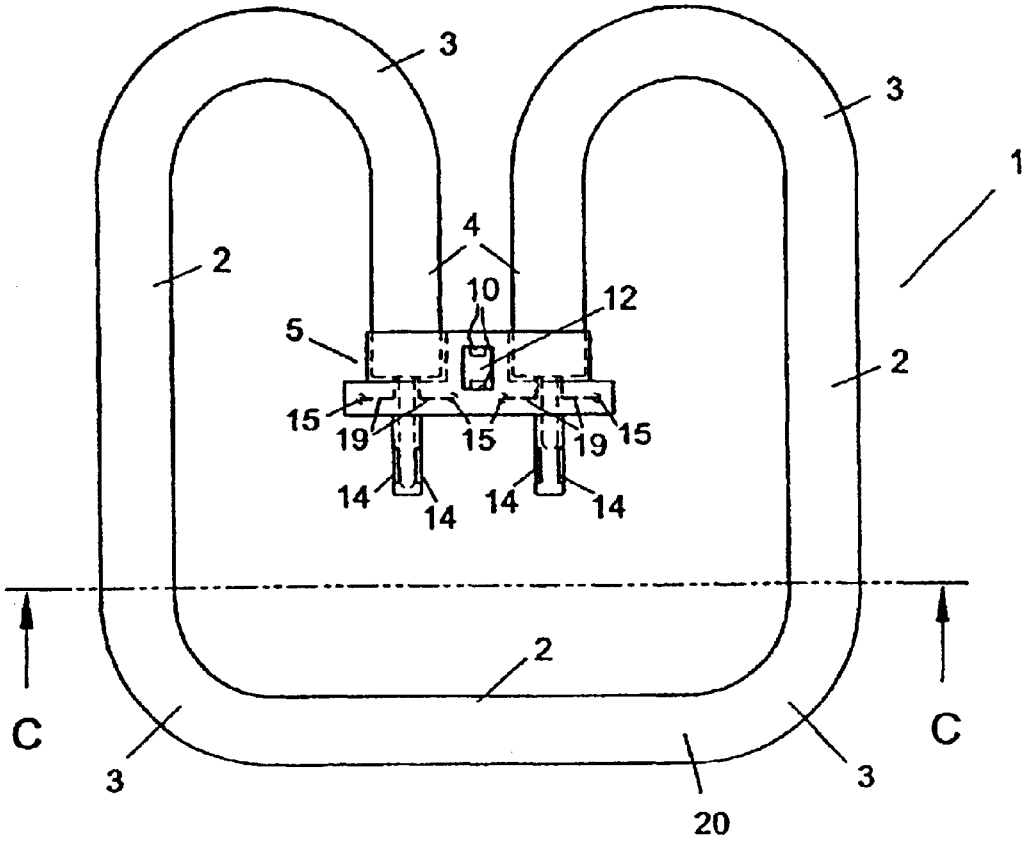
FIG. 5 is a top view of another possible embodiment of the discharge lamp.
Figure 6:
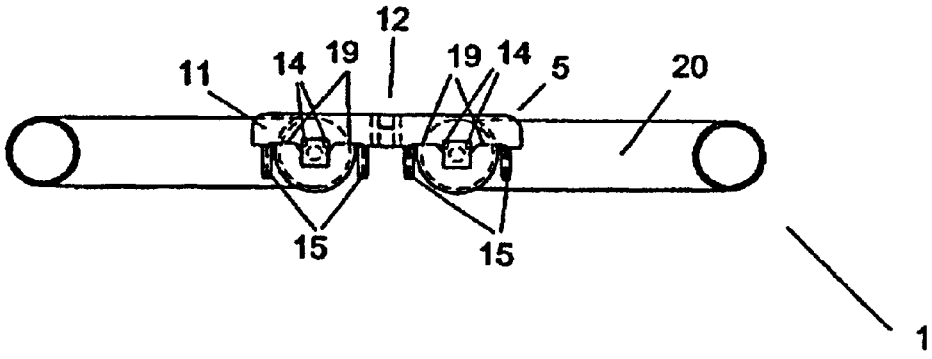
FIG. 6 is a side view section of the discharge lamp of FIG. 5 taken along the plane C—C.

The embodiment shown in FIGS. 5 and 6 was developed from the embodiment illustrated in FIGS. 3 and 4. In the embodiment of FIGS. 5 and 6, the base 5 and also the electrical connectors 15 connected to the cathode leads 19 do not protrude from the space bordered by the discharge tube 20 although the direction of the axes of the electrical connectors 15 is perpendicular to the plane of the discharge tube 20. It is seen in FIGS. 5 and 6 that this is due to the fact that each fixing component 10 providing for mechanical connection is placed in the opening 12, while indentations 14 representing two further connection points are placed in the middle of the space bordered by the discharge tube 20, next to the electrical connectors 15, substantially in the height of the electrical connectors 15. The indentations 14 are formed on extensions of the base 5, which otherwise accept the exhaust tubes of the discharge tube 20. This construction shows that the base 5 is made of a minimum amount of material and contains only the inevitable components.

Figure 7:
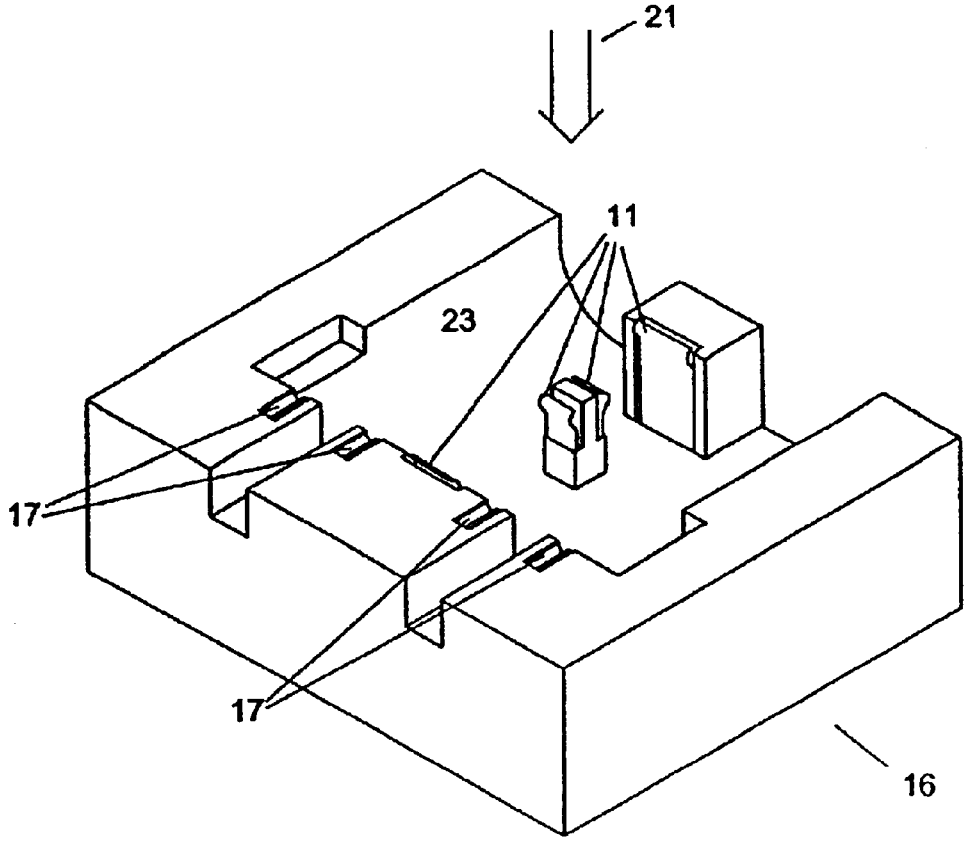
FIG. 7 is a perspective view of a possible embodiment of the lampholder belonging to the discharge lamp of FIG. 1.

FIG. 7 shows a lampholder 16 providing for the connection of the discharge lamp 1 seen in FIGS. 1 and 2 to the electrical mains. In the lampholder 16, a seat 23 and electrical contacts 17 as well as resilient tabs 11 made preferably from the material of the lampholder 16 are formed. The base 5 of the discharge lamp 1 is connected to the seat 23 from a direction 21 in such a way that the electrical connectors 15 get connected to the electrical contacts 17, and the fixing components 10 of the discharge lamp 1 and its seating surfaces 22 get connected to the tabs 11 in a resiliently fixed position. In this case, the direction 21 of connection of the discharge lamp 1 to the lampholder 16 is perpendicular to the plane of the discharge tube 20. Having made the connection, the overall height of the discharge lamp 1 and the lampholder 16 is still small since the electrical contacts 17 connected to the electrical connectors 15 as well as the tabs 11 connected to the seating surfaces 22 are placed next to each other, substantially in the same height.

Figure 8:
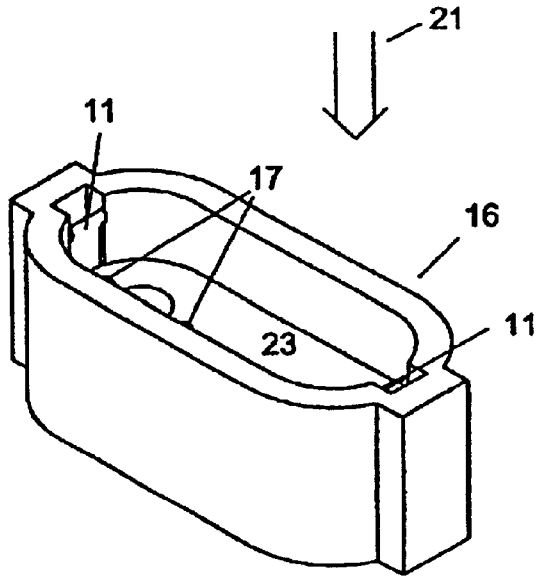
FIG. 8 is a perspective view of a further possible embodiment of the lampholder belonging to the discharge lamp of FIG. 1.

FIG. 8 shows, in perspective view, a further preferred embodiment of the lampholder 16 for the discharge lamp 1 seen in FIGS. 1 and 2 where the direction 21 of connection is parallel to the plane of the discharge tube 20. Here, the base 5 is fitted in the seat 23 in such a way that the electrical connectors 15 get in a resilient and fixed connection with the electrical contacts 17, and the fixing components 10 on both sides of the base 5 get in a resilient and fixed connection with the tabs 11. It is seen that the base 5 of the discharge lamp 1 according to FIGS. 1 and 2 is universal in the sense that it ensures the connection of the discharge lamp 1 of FIGS. 1 and 2 to the lampholders both of FIGS. 7 and 8 although the direction of connection is perpendicular to the plane of the discharge tube 20 in the first case and is parallel thereto in the second case.

Figure 9:
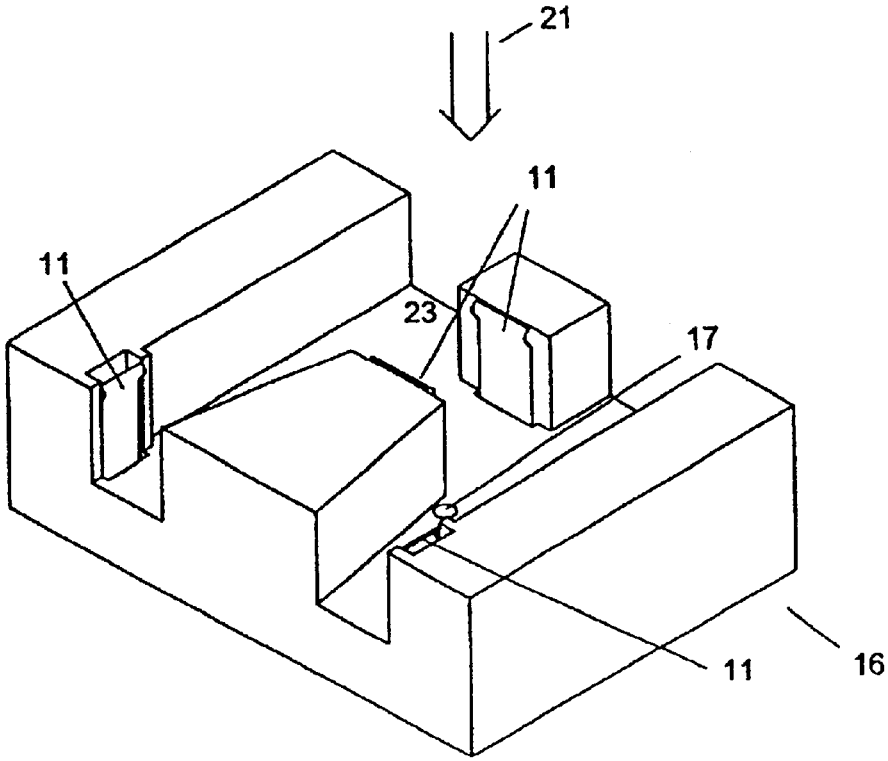
FIG. 9 is a perspective view of a possible embodiment of the lampholder belonging to the discharge lamp of FIG. 3.

FIG. 9 shows the perspective view of a possible embodiment of the lampholder 16 belonging to the discharge lamp 1 of FIGS. 3 and 4. Similarly to the lampholders 16 seen in FIGS. 7 and 8, a seat 23 is also formed in this lampholder 16. The base 5 of the discharge lamp 1 of FIG. 3 is fitted in this seat 23 from the direction 21 in such a way that the electrical connectors 15 and seating surfaces 22 get in fixed and resilient connection with the electrical contacts 17 and with the tabs 11, respectively. In this case, the direction 21 of connection of the discharge lamp 1 to the lampholder 16 is also perpendicular to the plane of the discharge tube 20.

Figure 10:
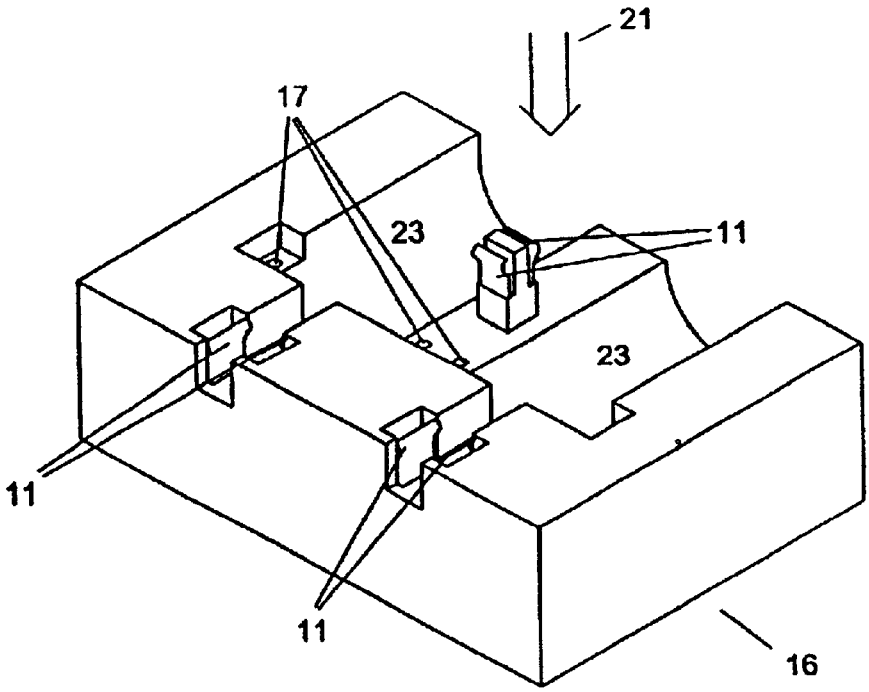
FIG. 10 is a perspective view of a possible embodiment of the lampholder belonging to the discharge lamp of FIG. 5.

The lampholder 16 shown in FIG. 10 ensures one of the best modes for decreasing the height of the discharge lamp 1. This lampholder 16 serves for accepting the discharge lamp 1 seen in FIG. 5. In this construction, the seat 23 is also placed in the lampholder 16, which serves for fitting the base 5. The electrical connectors 15 get in resilient and fixed connection with the electrical contacts 17, and the fixing components 10 as well as the indentations 14 get in resilient and fixed connection with the tabs 11. In this case, the direction 21 of connection of the discharge lamp 1 to the lampholder 16 is also perpendicular to the plane of the discharge tube 20. After connection, the overall height of the discharge lamp 1 and the lampholder 16 is still as small as the overall height in the case when connection is made parallel to the plane of the discharge tube 20. This is due to the feature that the electrical contacts 17 connecting to the electrical connectors 15 and the tabs 11 connecting to the seating surfaces 22 are placed side by side, quite in the same height, inside the space bordered by the discharge tube 20.

In the event of each lampholder 16 of FIGS. 7 through 10, the material of the tabs 11 may be identical with that of the lampholder 16, or the tabs 11 may be made of a resilient metal embedded into the lampholder 16.

Based on the recognition of the invention, further versions different from the above embodiments can also be made. So, e.g. in the case of the discharge lamp 1 according to FIG. 1, if the direction 21 of connection is perpendicular to the plane of the discharge lamp 1, it is not necessary that the axes of the electrical connectors 15 are parallel to each other. It is also not necessary that the number of mechanical connections is that shown in the figures. A safe connection can be made using less or more components than that shown in the figures. Seating surfaces 22 can be formed also on the base 5 of the discharge lamp 1 seen in FIGS. 5 and 6 next to or instead of the fixing components placed in the opening 12. Although the invention has been elaborated primarily for 2D-shaped low-pressure discharge lamps, its advantages can be exploited in the case of any discharge tube bent in substantially one plane.

What is claimed is:

1. A low-pressure discharge lamp including a discharge tube and a base providing for mechanical and electrical connection of the lamp, and the discharge tube sealed in a gas-tight manner at its both ends is bent in substantially one plane so that the discharge tube has straight and arc-shaped portions, and the base connected to the ends of the discharge tube includes at least cathode leads of the discharge tube and electrical connectors connected to said leads, and at least one component ensuring mechanical connection to a lampholder is formed on the base wherein each component of the discharge lamp ensuring mechanical connection to the lampholder is separate from the electrical connectors and placed in a space bordered by the discharge tube and positioned within a height of the discharge tube.

2. The discharge lamp of claim 1 in which the electrical connectors are also placed in the space bordered by the discharge tube.

3. The discharge lamp of claim 2 in which the axes of the electrical connectors are parallel to the plane of the discharge tube.

4. The discharge lamp of claim 3 in which the axes of the electrical connectors are parallel to each other.

5. The discharge lamp of claim 1 in which the axes of the electrical connectors are perpendicular to the plane of the discharge tube.

6. The discharge lamp of claim 1 in which its components ensuring mechanical connection to the lampholder are formed as fixing components or seating surfaces.

7. The discharge lamp of claim 1 in which an opening is formed in the base and at least one fixing component is placed in said opening.

8. The discharge lamp of claim 1 in which the discharge tube has a 2D-shape.

* * * * *